US005430930A

United States Patent [19]

Passoni et al.

[11] Patent Number: 5,430,930

[45] Date of Patent: Jul. 11, 1995

[54] METHOD OF MANUFACTURING HOT STRIP

[75] Inventors: Roberto Passoni, Coraopolis; Giuseppe Facco, Pittsburgh, both of Pa.

[73] Assignee: Italimpianti of America, Inc., Coraopolis, Pa.

[21] Appl. No.: 134,595

[22] Filed: Oct. 12, 1993

[51] Int. Cl.[6] ..... B21B 1/46; B21B 13/22

[52] U.S. Cl. ..... 29/527.6; 29/527.7; 29/33 C; 72/202; 72/229

[58] Field of Search ..... 29/527.7, 527.6, 33 C, 29/81.03; 72/200, 202, 229

[56] References Cited

U.S. PATENT DOCUMENTS

| | | | |
|---|---|---|---|
| 4,019,359 | 4/1977 | Smith | 73/231 |
| 4,348,882 | 9/1982 | Tippins | 72/202 |
| 4,497,191 | 2/1985 | Langer et al. | 72/202 |
| 4,503,697 | 3/1985 | Tippins et al. | 72/202 |
| 4,522,050 | 6/1985 | Thomas | 72/229 |
| 4,580,428 | 4/1986 | Brettbacher et al. | 72/226 |
| 4,664,701 | 5/1987 | Royzman | 75/51.1 |
| 4,675,974 | 6/1987 | Connolly | 29/527 |
| 4,698,897 | 10/1987 | Frommann et al. | 29/527.7 |
| 4,817,703 | 4/1989 | Rohde et al. | 164/476 |
| 4,829,656 | 5/1989 | Rohde | 29/527.7 |
| 4,976,024 | 12/1990 | Kimura | 29/527.6 |
| 4,998,338 | 3/1991 | Seidel et al. | 29/527.6 |
| 5,035,036 | 7/1991 | Bohnenkamp | 29/33 |
| 5,075,953 | 12/1991 | Braud | 29/527.7 |
| 5,082,047 | 1/1992 | Bricmont | 164/476 |
| 5,094,094 | 3/1992 | Muramatsu et al. | 72/200 |
| 5,104,412 | 5/1991 | Nobis et al. | 29/527.7 |
| 5,115,547 | 5/1992 | Rohde | 29/33 |
| 5,150,597 | 9/1992 | Sekiya et al. | 72/229 |
| 5,182,847 | 2/1993 | Guse et al. | 29/527.7 |

FOREIGN PATENT DOCUMENTS

| | | | |
|---|---|---|---|
| 0320846 | 6/1989 | European Pat. Off. | B21B 1/06 |

*Primary Examiner*—Timothy V. Eley
*Assistant Examiner*—Khan V. Nguyen
*Attorney, Agent, or Firm*—Webb Ziesenheim Bruening Logsdon Orkin & Hanson

[57] ABSTRACT

A method and apparatus for manufacturing hot strip steel includes a continuous slab caster adapted to cast a strand of 4 inches or more in thickness. The strand is cut to slab length and heated in a roller hearth furnace or a walking beam furnace prior to entry into a multi-stand tandem reversing mill. The slab is rolled in a downstream direction through the mill in a first reducing pass. The mill is reversed and the elongated slab is rolled in an upstream direction through the mill in a second reducing pass. The intermediate bar exits the upstream end of the mill and is coiled in a coil box positioned intermediate the furnace and the reversing mill. The bar is then unwound from the coil box for rolling in the downstream direction through the mill in a third and finish pass. The finish gauge strip moves down a run out table downstream from the mill for coiling in a down coiler apparatus.

7 Claims, 2 Drawing Sheets

METHOD OF MANUFACTURING HOT STRIP

BACKGROUND OF THE INVENTION

The present invention relates generally to the manufacture of hot rolled steel strip from continuous slab casters and, more particularly, to a method and apparatus for increasing the productivity of the mill. Use of a continuous caster greatly reduces the size and expense of the plant due to the elimination of ingot casting, reheating and blooming and slabbing mills.

It is known to continuously cast steel into thin slab, on the order of 2 to 2½ inches (≈50–65 mm) thick, and to subsequently cut and process the lengths of cut material directly to strip on a hot finishing mill train. A buffer, in the form of a furnace, is usually provided between the casting station and the rolling mill to keep the cast material hot prior to rolling and to accommodate the difference in casting and rolling speeds. The cast stand is cut into a desired slab length downstream of the caster and the slab is either maintained in an elongated flat shape or it is coiled and held in the furnace buffer prior to finish rolling. U.S. Pat. Nos. 4,829,656 to Rohde and 4,698,897 to Frommann, et al. are exemplary of these above-mentioned known processing techniques for producing hot strip to finish gauge from a continuous caster.

It has been common practice to roll the cast slabs from the buffer furnace into finish hot strip on a multi-stand continuous finishing mill line. Single stand reversing finishing mills with coil boxes on upstream and downstream sides of the mill have also been proposed as noted in the aforementioned U.S. Pat. No. 4,698,897 to Frommann, et al. and also in U.S. Pat. No. 5,150,597 to Sekiya, et al. to further process the material into finish strip gauge. In U.S. Pat. No. 4,998,338 to Seidel, et al., thin continuously cast slab, on the order of 2–2½ inches thick (≈50–65 mm), is finish rolled in a 3 or 4 stand reversible finishing mill train with a coil box located at the downstream end thereof. The mill is supplied with metal from one or two continuous casters. The cast strands are cut into slab length after solidification and then heated in a soaking furnace to a selected rolling temperature prior to rolling in the reversible finishing train.

There has been a trend in recent years toward the installation of compact mills where a thin slab caster is directly connected to a continuous hot finishing mill. While these proposed mill configurations offer many advantages over conventional continuous hot strip mills, such as reduced space requirements, lower installation costs and lower man-hours per ton, there are, nevertheless, a number of significant disadvantages present in these compact mills. Among such disadvantages are low productivity (about 800,000 tons/year); and unbalanced production between the continuous caster and the finishing mill train (800,000 tons/year per caster and 3,000,000 tons/year for the finishing mill). In addition, the continuous finishing trains are expensive and require high installed horsepower to reach thin finished gauges. A common final strip thickness of 2 mm is oftentimes difficult to obtain in these mills. Finally, these prior mills are limited to a relatively narrow range of steel grades.

The present invention overcomes the disadvantages and shortcomings of the prior art by providing a compact hot strip mill and continuous slab caster which significantly increases the annual production over conventional strip slab casters.

The present invention further provides a less complex mold design in the continuous caster and increases the number of steel grades which may be cast. In addition, the invention permits the production of shorter length slabs compared to conventional strip cast slabs, thus, making it easier to shift slabs when operating a multi-strand caster along with the possibility of employing shorter length soaking/buffer furnaces.

Still further, the present invention provides a finishing mill configuration having fewer mill stands than conventional continuous strip mills with lower installed motor horsepower. The finishing mill component of the invention is supplied with a greater ton/hour output of steel from the caster to provide a more balanced production and take advantage of the heretofore greater output capabilities of the finishing mill. As a result of the higher output of the caster, the invention provides reduced bar-to-bar waiting time which allows the mill to run at steady state conditions for greater periods of time than heretofore possible.

SUMMARY OF THE INVENTION

These, as well as other advantages and objectives are provided by the present invention which, briefly stated, comprises a one or two strand continuous slab caster, an in-line furnace, an intermediate coiler, a multi-stand, reversible finishing mill train and a finish strip coiler downstream of the finishing mill. The continuous caster produces a slab strand or strands of medium to moderately heavy thickness, for example from about 4 inches to about 6.5 inches (100–170 mm) in thickness. Preferably, the cast slab is about 4 inches in thickness. If cast slab has a thickness greater than 4 inches, it is preferable to use an intermediate, one-way roughing mill stand to reduce such heavier material to about 4 inches in thickness prior to introduction into the finishing mill train.

In either event, the solidified cast strand(s) from the caster is cut to a desired slab length of, for example, about 85 feet (26 meters) downstream of the caster and prior to entry into an in-line roller hearth furnace. The cut slabs advance through the furnace, while being heated to a proper temperature in preparation for rolling.

The finishing mill train preferably comprises four reversible mill stands. The last, or fourth mill stand at the downstream position, preferably remains idle in all passes except for the final, third finish pass, so as to improve strip surface quality and prolong the roll life of the work rolls of the last finish mill stand. In operation, a preheated slab enters the finishing mill train and is reduced in a first pass in the first three mill stands to a thickness of about 1⅜–1¾ inches (35–40 mm) and concurrently elongated to a length of about 230 feet (70 meters). The rolls of the finishing mill are then rotated in a reverse direction to carry out a second pass in an upstream direction to reduce the material to a thickness of about 5/16–9/16 inches (8–15 mm). The greatly elongated material from the second rolling pass is taken up in an intermediate coiler, preferably an up coiler, located between the furnace and the finishing mill. The material is then withdrawn from the intermediate coiler for the third and last pass through all four of the stands of the mill traveling in the downstream direction. The rolls of the fourth mill stand engage the material to establish a finish gauge. The finished strip having a minimum thickness in the range of 0.060–0.080 inches (down to 1.5 mm) moves along a run out table to a down coiler for coiling. Finished coils, on the order of about 30 tons each, are typically produced.

DETAILED DESCRIPTION OF THE INVENTION

Figure 1:
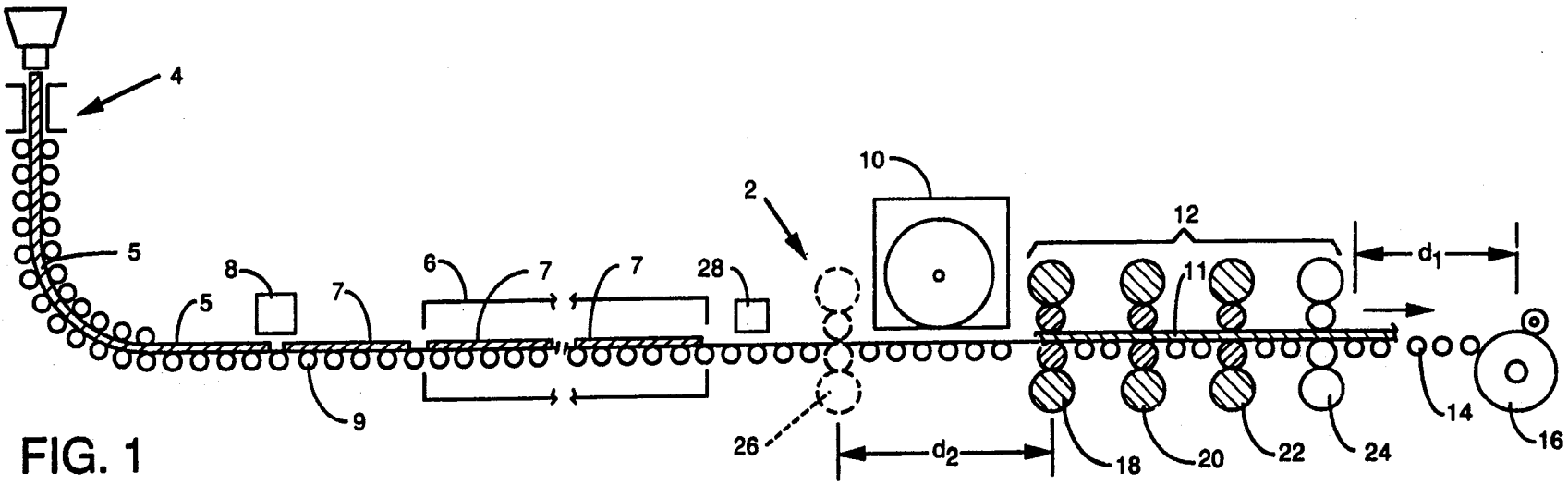
FIG. 1 is a schematic side elevational view of a hot strip manufacturing plant according to the invention depicting a finishing mill train in a first pass rolling operation.

Referring now to the drawings, FIGS. 1–4 schematically depict an apparatus and method according to the present invention. The hot strip mill according to the present invention generally designated 2 in the drawings is situated downstream from a continuous slab caster 4. The slab caster 4 produces a continuous steel strand 5 having a thickness on the order of about 100 mm or 4 inches in thickness. A conventional cutting apparatus such as a torch cutter 8 cuts the cast strand 5 at predetermined intervals. The strand is cut into slabs 7 of a desired length determined by the required finish coil size. A typical length for a 4 inch thick slab may be about 85 feet (26 meters).

A conventional roller support system 9 conveys the cut slabs 7 to an in-line, roller hearth furnace 6 for heating the slabs to a prescribed rolling temperature. The roller hearth furnace 6 contains sufficient accumulation space to permit from about 5 to 10 minutes of mill outage without stopping the continuous caster sequence. Heated slabs 7 exit the furnace 6 for subsequent processing in a tandem hot mill 12. The mill 12 comprises a train of four high reversing mill stands. Preferably four such reversing mill stands are employed, designated 18, 20, 22 and 24 in the drawings. A coiler box 10, preferably an up coiler, is situated above the roller support table 9 intermediate the furnace 6 and the mill 12. A coiler 16, preferably a down coiler, for receiving finish strip is situated at the end of a run out table 14 downstream of the tandem hot mill 12. A conventional descaler 28 is also situated intermediate the furnace 6 and the tandem hot mill 12 for removing scale from the slabs 7 prior to finish rolling. In addition, a crop shear (not shown) may also be situated between the coiler 10 and the tandem mill 12 for cropping the ends of the workpiece prior to the finish pass in the mill.

In operation, a typical first pass is depicted in FIG. 1. A slab 7 enters the tandem hot mill 12 and is rolled therein in a first pass while utilizing the first three mill stands 18, 20 and 22 to reduce the slab in thickness while greatly extending the length thereof. During the first pass, the fourth mill stand 24 remains idle. The slab 7 is converted to a transfer bar 11 during the first pass, to transform an original slab length of for example 85 feet (26 meters) and a thickness of 4 inches (100 mm) to a bar length of about 70 meters and a thickness of about 35–40 mm while rolling in a downstream direction along the run out table 14. The coiler 16, which is adapted to receive the finished hot strip material, is located a distance indicated D1 in FIG. 1 from the downstream end of the tandem hot mill 12. The distance D1 is greater than the anticipated length of the transfer bar 11 formed during the first pass from the mill 12 which, in this case, would be in excess of 70 meters.

Figure 2:
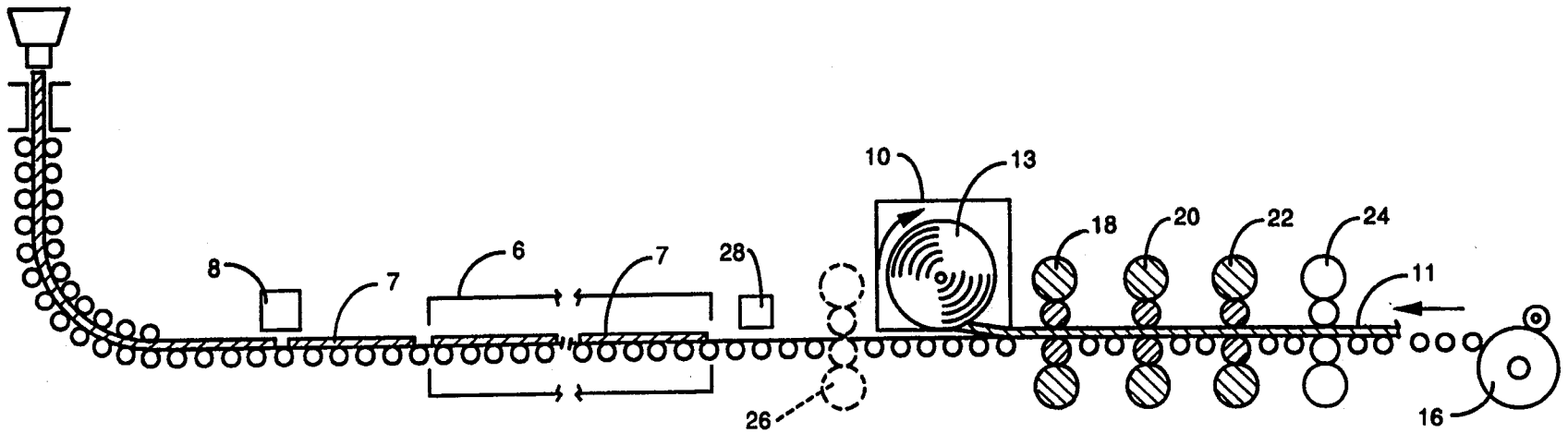
FIG. 2 is a view similar to FIG. 1 showing the mill in a second pass rolling operation.

The second pass is depicted in FIG. 2 wherein the transfer bar 11 is rolled in a reverse or upstream direction through the mill stands 18, 20 and 22 for a further reduction in thickness and an increase in length to form an intermediate bar 13. The intermediate bar 13 is received in the coiler box 10 as it exits the first stand 18 of the tandem hot mill 12. Typically, in the second pass, the transfer bar 11 is reduced to a thickness of between about 8 mm and 15 mm in thickness.

Figure 3:
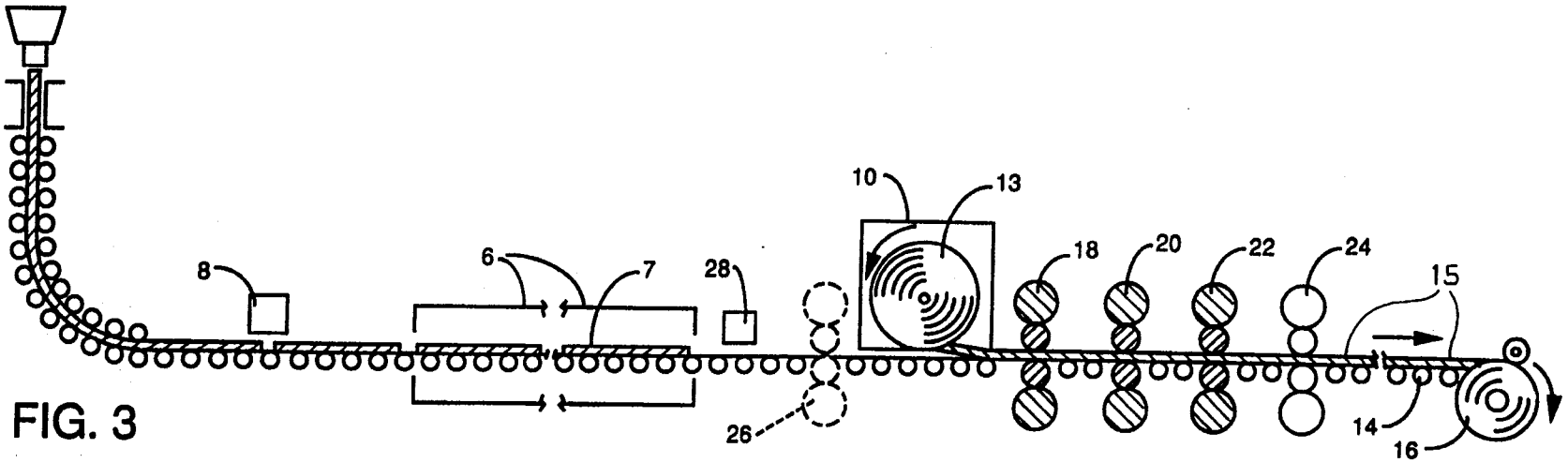
FIG. 3 is a view similar to FIGS. 1 and 2 depicting the mill in a third and final pass rolling operation.
Figure 4:
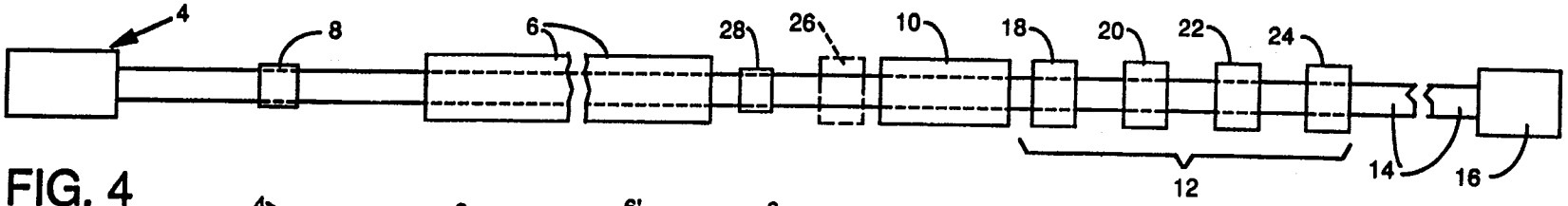
FIG. 4 is a schematic plan view of the hot strip plant of FIGS. 1–3.

In the third and final pass, depicted in FIG. 3, the intermediate bar 13 is withdrawn from the coiler box 10 and rolled in the downstream direction to a finish thickness through the mill stands 18, 20, 22 and 24. The finish strip material 15 is then fed into the down coiler 16 in a traditional manner. The fourth mill stand 24 is thus activated only during the last rolling pass to engage the strip 15 and impart the final reduction to size. In this manner, the work rolls of the final mill stand 24 stay in service longer than otherwise would be possible. During the final rolling pass depicted in FIG. 3, the intermediate bar 13 may be reduced to finish strip 15 having a thickness down to 1.5 mm.

In order to process slabs 7 having a thickness greater than 4 inches, a one-way roughing mill stand 26 may be positioned at the exit side of the reheat furnace 6. In this manner, for example, a slab 7 having a thickness of 6 or 6½ inches may be reduced in the one-way mill 26 to a thickness of 4 inches prior to entry into the first stand 18 of the tandem hot mill 12. As seen in FIG. 1, the one-way rolling mill 26 is positioned upstream of the first mill stand 18 a distance indicated as D2 in the drawing. The dimension D2 is slightly in excess of the reduced slab length exiting the mill 26, which may be, for example, on the order of about 85 feet (26 meters).

Figure 5:
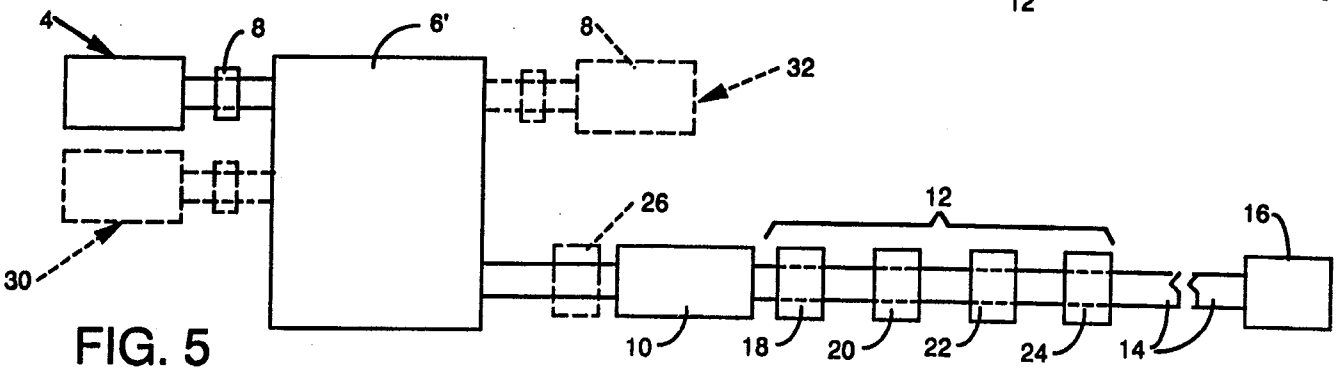
FIG. 5 is a schematic plan view of a further embodiment of a hot strip plant according to the invention employing a walking beam type furnace to heat the slabs prior to rolling.

In an alternate embodiment depicted schematically in FIG. 5, the elongated roller hearth furnace 6 shown in FIGS. 1–4 can be replaced with a walking beam furnace 6' which necessarily reduces the overall length of the installation. Such a walking beam furnace performs the same function as the elongated furnace 6, namely, to heat the pre-cut slabs to a proper rolling temperature prior to entry into the tandem hot mill 12. The walking beam furnace 6' may receive slabs from a slab caster 4, or from a second slab caster 30 situated on the same side, or from a caster 32 located on an opposite side of the furnace 6'.

The continuous strands of steel produced from the casters 4, 30 or 32 are cut to desired slab lengths by the torch cutters 8 and then subsequently fed into the walking beam furnace 6'. The heated slabs then exit the walking beam furnace 6' for rolling in the tandem hot mill 12 in the three-pass sequence as previously described. A shuttlecar may also be employed to connect the two lines of a two-strand caster for use in an insulating or roller furnace type.

Thus, the process of the invention employs four reversing mill stands connected in tandem to reduce the slab thickness down to 1.5 mm. The process is completed in three rolling passes through the rolling mill train wherein the second pass is a reverse pass producing an intermediate bar which is temporarily coiled in the intermediate up coiler 10 so as to reduce the overall length of the mill. The last stand 24 of the mill train 12 is preferably kept idle during the first two passes and used only during the last pass for the final strip touch-up. Thus, the present invention is advantageous due to the fewer number of mill stands installed as well as a lower installed motor horsepower. The coiler 10 may be fully or partially insulated or it may be heated if necessary to maintain the intermediate strip temperature. The run out table 14 may, likewise, be provided with a heavy-duty reversing segment immediately downstream from the tandem mill 12 to assist in the second reverse rolling pass.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A process for making hot strip material comprising:

(a) casting in a continuous slab caster at least one strand of steel having a thickness of at least about 4 inches;

(b) cutting the strand to form slabs of a desired length;

(c) heating the slabs in a furnace means to a desired temperature;

(d) providing a finishing mill train of at least three reversing mill stands;

(e) providing a coil box means at an intermediate location between the furnace means and an upstream end of the finishing mill train;

(f) providing a finish strip coiler means at a downstream location from the finishing mill train;

(g) rolling the heated slab in a first pass in a downstream direction through the finishing mill train to reduce the thickness and elongate the slab a desired amount;

(h) rolling the slab of step (g) in a second pass in an upstream direction through the finishing mill train to further reduce the thickness and elongate the slab;

(i) coiling the slab from step (h) in said coil box means as said further reduced and elongated slab leaves the upstream end of the finishing mill;

(j) uncoiling said slab from the coil box means and rolling the slab in a third pass in the downstream direction through the finishing mill train to reduce the thickness of the slab to a desired thickness to produce a finish strip; and (k) coiling the finish strip on the finish strip coiler means.

2. The process of claim 1 wherein the cast strand is at least 6 inches thick and wherein said process further includes providing a roughing mill stand in a location between the furnace means and the finishing mill train; and rolling the heated slab of at least 6 inches in thickness in the roughing mill stand to a thickness of about 4 inches prior to the first rolling pass in the finishing mill train.

3. The process of claim 1 wherein the finishing mill train comprises four mill stands and wherein during said first and second rolling passes, three of said mill stands reduce and elongate said slab, while a fourth mill stand, located on the downstream end of said finishing mill is in an idle mode; and during said third rolling pass, the four mill stands operably engage the slab wherein the fourth mill provides the desired finish strip thickness.

4. The process of claim 1 wherein the finish strip thickness is at least 0.06 inches.

5. The process of claim 1 wherein the furnace means is a roller hearth furnace.

6. The process of claim 1 wherein the furnace means is a walking beam furnace.

7. The process of claim 1 wherein, during the heating step, the slabs are heated to about 1250° C.

* * * * *